United States Patent [19]

Baumann

[11] Patent Number: 4,973,279

[45] Date of Patent: Nov. 27, 1990

[54] APPLIANCE FOR ASSISTING A SWIMMER SWIM, FLOAT AND/OR BEING TOWED BEHIND A BOAT

[76] Inventor: Franz Baumann, Zur Weissen Frau 5, D-5760 Brilon-Rösenbeck, Fed. Rep. of Germany

[21] Appl. No.: 354,439

[22] PCT Filed: Aug. 16, 1988

[86] PCT No.: PCT/EP88/00729

§ 371 Date: Jun. 19, 1989

§ 102(e) Date: Jun. 19, 1989

[87] PCT Pub. No.: WO89/02391

PCT Pub. Date: Mar. 23, 1989

[30] Foreign Application Priority Data

Sep. 10, 1987 [DE] Fed. Rep. of Germany ... 8712281[U]

[51] Int. Cl.[5] ..... B63B 35/72

[52] U.S. Cl. ..... 441/135; 441/65; 114/66

[58] Field of Search ..... 441/135, 65, 67, 74; 114/56, 66, 315, 343, 355–358

[56] References Cited

U.S. PATENT DOCUMENTS

| | | | |
|---|---|---|---|
| 2,712,139 | 7/1955 | Kelly | 441/135 |
| 2,717,399 | 9/1955 | Backhouse | 441/135 |
| 3,042,945 | 7/1962 | Saeman | 441/135 |
| 3,081,726 | 3/1963 | Betts | 441/135 |
| 3,085,356 | 4/1963 | Wayfield | 441/135 |
| 3,808,621 | 5/1974 | French | 441/135 |
| 4,465,468 | 8/1984 | Deacy | 441/135 |
| 4,691,658 | 9/1987 | New | 441/135 |
| 4,715,837 | 12/1987 | Floyd | 441/135 |
| 4,723,329, | 2/1988 | Vaccaro | 441/135 |
| 4,850,914 | 7/1989 | Cox | 44/135 |

*Primary Examiner*—Joseph F. Peters, Jr.
*Assistant Examiner*—Clifford T. Bartz
*Attorney, Agent, or Firm*—Michael J. Striker

[57] ABSTRACT

The appliance for assisting a swimmer in swimming, floating and being towed by a boat, includes a substantially board-shaped floating body having a leading edge and a trailing edge each of which have a V-shaped cross section. The floating body has a glass panel with a transverse reinforcing web mounted centrally therein so that the swimmer can observe through the floating body. The floating body has two longitudinal sides each having a handle in the shape of an arcuate protrusion projecting therefrom. Each of the handles is located in the middle of its longitudinal side, and the longitudinal sides are divided by a central transverse axis, each of the handles having a through-going handle opening positioned between the transverse axis and the leading edge. Fastening means, such as screws, are provided on each handle and a tow rope is attached to each of the fastening means by one of its two ends. The middle portion of the rope is attachable to the boat, preferably by a trailing rope from the boat, so that the swimmer may be towed by the boat while executing lateral gliding motions or diving below the water's surface.

8 Claims, 2 Drawing Sheets

APPLIANCE FOR ASSISTING A SWIMMER SWIM, FLOAT AND/OR BEING TOWED BEHIND A BOAT

My present invention relates to an appliance for assisting a swimmer in the water and, more particularly, to an appliance for assisting a swimmer swim or float in the wake of or behind a moving boat or for assisting a swimmer being towed by the boat.

SUMMARY OF THE INVENTION

It is an object of the present invention to provide a simple appliance by means of which a sport swimmer may be easily towed and/or swim behind or in the wake of a boat.

It is a further object of the present invention to provide a simple appliance by means of which a sport swimmer may be towed and/or swim behind a moving boat which allows the swimmer to easily glide laterally in the water and to dive and swim below the water for certain distances.

According to my invention the appliance for assisting a swimmer in swimming, floating or being towed in the wake of or behind a boat, comprises a substantially board-shaped floating body having a leading edge and a trailing edge. Each of the leading and trailing edges have a V-shaped cross section. The floating body has a glass panel mounted centrally therein so that the swimmer can observe through the floating body and the floating body has two longitudinal sides each having a handle in the shape of an arcuate protrusion projecting therefrom. Each of the handles are located in the vicinity of the center of the longitudinal side, and the longitudinal sides are divided by a central transverse axis of the floating body. Each of the handles have a through-going handle opening positioned between the transverse axis and the leading edge.

The floating body is advantageously nearly square except for the protruding handles.

The glass panel may advantageously be provided with a transverse reinforcing web for greater strength.

A depression for the comfort of the hand is advantageously provided in each handle on the other side of the transverse axis opposite that having the through-going opening.

Other features are described in the appended dependent claims including fastening means for a tow rope and a tow rope assembly.

During use, the appliance is fastened by means of a tow rope to the boat or a trailing rope of a boat. The swimmer is drawn by the boat in the wake thereof in the swimming position, the appliance being grasped by his hands laterally at the handles. The floating body has a carrying effect also when the dragging boat does not have any speed. When the boat is moving the swimmer has the possibility to veer out to the left or to the right or to dive over certain distances by differently adjusting the floating body, e.g. by pivoting it about the transverse axis or by an inclined position of the longitudinal axis relative to the direction of movement. The transverse distance of the handles of, for example, 70 to 80 cm and the arrangement of the handle openings in front of the transverse axis facilitate the handling for the swimmer. By the fact that the ends of the tow rope are arranged in front of the transverse axis, the stability of the floating body during motion of the boat is ensured. Furthermore, either above water or below water, the swimmer has the possibility to observe the world below water surface through the glass panel.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
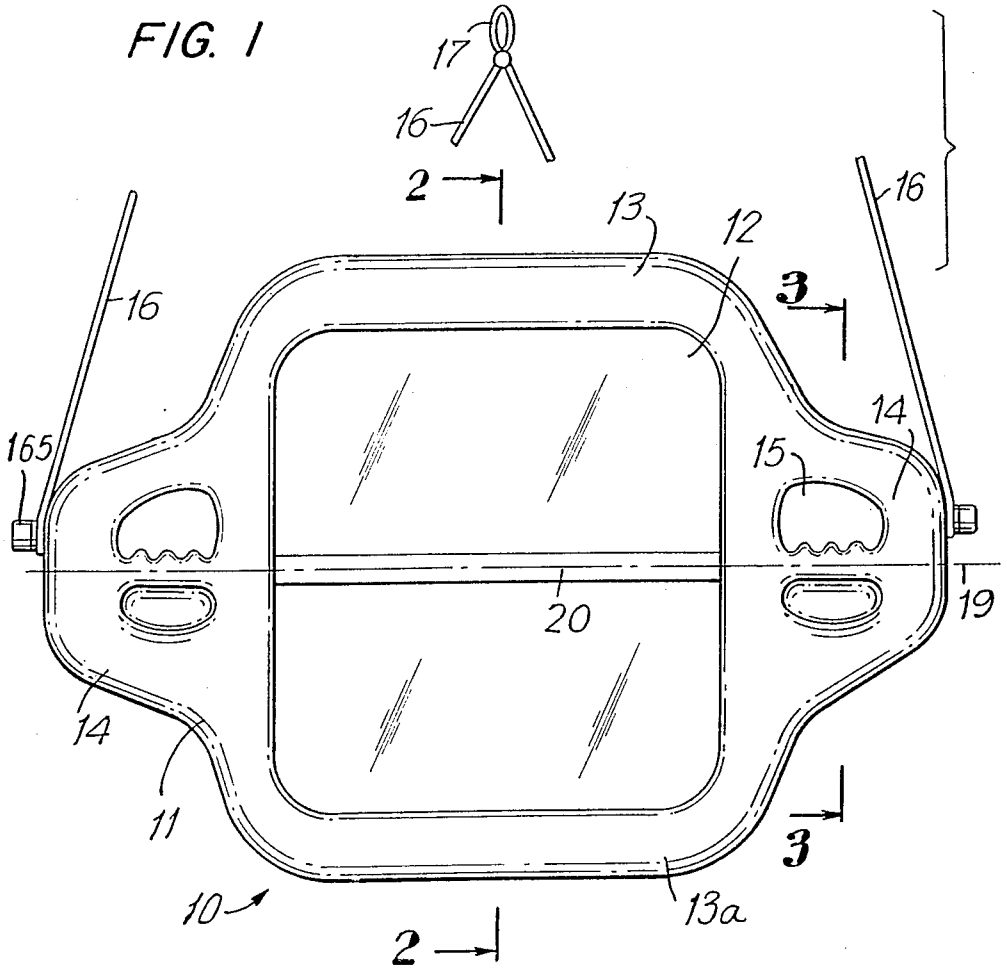
FIG. 1 is a plan view of the appliance according to the invention.
Figure 2:
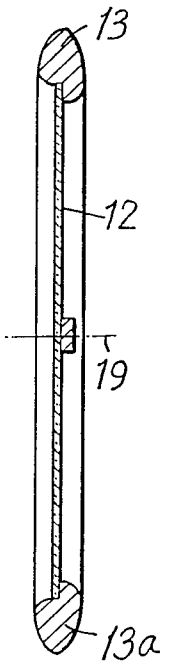
FIG. 2 is a section on the line II-II of FIG. 1.
Figure 3:
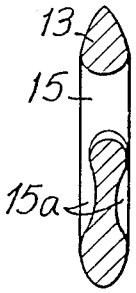
FIG. 3 is a section on the line III-III of FIG. 1.

The embodiment of the appliance shown in the drawing comprises a board-like floating body 10 with a square or approximately square shape. In the center part, there is inserted a transparent glass panel 12. At both longitudinal sides 11 the floating body has arcuate protrusions forming handles 14 which each have a handle opening 15. The through-going handle openings 15 are in each case provided in front of a transverse axis 19 in the middle of the longitudinal sides. A handle depression 15*a* is associated with each handle opening 15 behind the transverse axis 19.

By "in front of a transverse axis" we mean between the transverse axis 19 and the leading edge 13 and by "behind the transverse axis we mean" between the transverse axis 19 and the trailing edge 13*a*.

Due to flow-line reasons, the leading edge 13 and also the trailing edge 13*a* of the floating body are formed V-shaped. This shape also extends over the handles 14.

For the purpose of coupling the floating body 10 to a trailing rope 18 of a boat 30, there is provided a tow rope 16. The ends of the rope are each fastened to screws 16S which in their turn are laterally mounted at the handles 14 and project therefrom, these screws 16S being provided in the region of the handle openings 15, i.e. in front of the transverse axis 19. The tow rope 16 is dimensioned such that it assumes a V-shaped form in the stretched condition, the vertex 17 lying in front of the floating body. There, the trailing rope of the boat is fastened.

Figure 4:
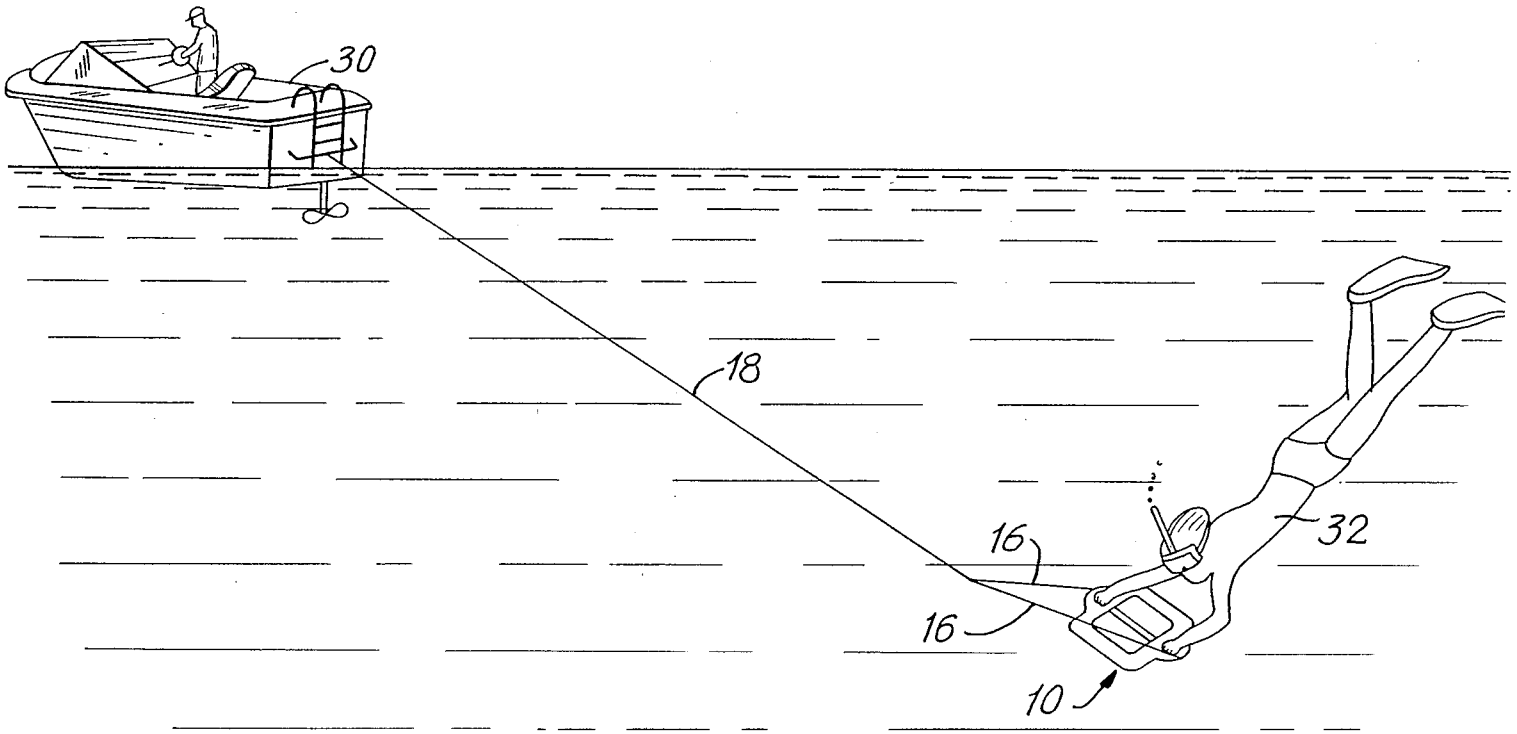
FIG. 4 shows the use of the appliance according to the invention.

FIG. 4 shows the use of the appliance. The swimmer 32 grasps the appliance in the swimming position at the handles 14 and has himself towed by the boat at an appropriate and not very high speed. He has the possibility to adjust the position of the floating body 10 in such a manner that he may move out to the left or to the right in the swimming position like during water skiing. Additionally there exists the possibility of diving over certain distances in that the swimmer adjusts the leading edge of the floating body in such a manner that it is inclined downwardly.

Also in the position of rest, the appliance is floating flatly on the water surface and offers the possibility of observing the world below water surface through the glass panel without being disturbed by wave motions.

While the invention has been illustrated and described as embodied in an appliance for assisting a swimmer swim, float and/or being towed behind a boat, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Appliance for assisting a swimmer in swimming, floating and being towed by a boat, comprising a substantially board-shaped floating body having a leading edge and a trailing edge, each of said edges having a V-shaped cross section which is symmetrical relative to a horizontal transverse plane of said floating body, said floating body having a glass panel mounted centrally therein so that said swimmer can see through said floating body, said floating body having two longitudinal sides, each of said longitudinal sides having a center and a handle in the shape of an arcuate protrusion projecting from said longitudinal side, each of said handles being located in the center of said longitudinal side, and said longitudinal sides being divided by a central transverse axis of said floating body, each of said handles having a through-going handle opening positioned between said transverse axis and said leading edge.

2. Appliance according to claim 1, wherein each of said handles is positioned at the center of said longitudinal side and said transverse axis passes through said handles.

3. Appliance according to claim 1, wherein said floating body is substantially square shaped.

4. Appliance according to claim 1, wherein each of said handles is provided with a depression located between said transverse axis and said trailing edge.

5. Appliance according to claim 1, further comprising a transverse web in the region of said glass panel, said transverse web providing reinforcement of said glass panel.

6. Appliance according to claim 1, further comprising fastening means for a tow rope on each of said handles located between said transverse axis and said leading edge.

7. Appliance according to claim 6, further comprising a tow rope having two ends and a middle portion with a vertex, each of said ends being attached by said fastening means to each of said handles between said transverse axis and said leading edge and said middle portion being connectable to said boat for towing by a trailing rope from said boat.

8. Appliance for assisting a swimmer in swimming, floating and being towed by a boat, comprising:

a substantially board-shaped floating body having a leading edge and a trailing edge each of said edges having a V-shaped cross section, said floating body having a glass panel mounted centrally therein so that said swimmer can observe through said floating body, said floating body having two longitudinal sides, each of said longitudinal sides having a center and a handle in the shape of an arcuate protrusion projecting from said longitudinal side, each of said handles being located in the vicinity of the center of said longitudinal side, and said longitudinal sides being divided by a central transverse axis of said floating body, each of said handles having a through-going handle opening positioned between said transverse axis and said leading edge, a tow rope having two ends, the ends of which are each fastened to the handles between the transverse axis and said leading edge and a middle portion of said rope being attachable to said boat so that said swimmer may be towed by said boat, and a transverse web located in the region of the glass panel reinforcing said floating body.

* * * * *